US006060142A

United States Patent [19]

Rossini

[11] Patent Number: 6,060,142

[45] Date of Patent: May 9, 2000

[54] UNIVERSAL THREE-DIMENSIONAL CAMOUFLAGE SYSTEM

[76] Inventor: Michael J. Rossini, 169 Everett St., Apt. #3, Quincy, Mass. 02169

[21] Appl. No.: 09/255,243

[22] Filed: Feb. 22, 1999

[51] Int. Cl.[7] ..... B32B 7/08

[52] U.S. Cl. ..... 428/52; 428/26; 428/52; 428/99; 428/100; 428/193; 428/919; 2/1; 2/94; 2/271

[58] Field of Search ..... 428/919, 17, 21, 428/26, 115, 193, 100, 99, 52; 2/69, 94, 1, 271, 336; 24/563, 706.1; 248/816.7

[56] References Cited

U.S. PATENT DOCUMENTS 4,517,230 5/1985 Crawfrod .
4,792,471 12/1988 Lee .
5,010,589 4/1991 Hamilton .
5,203,033 4/1993 Sheppard, Sr. .
5,274,848 1/1994 Shamblin .
5,742,985 4/1998 Larrabee ..... 24/563

*Primary Examiner*—Deborah Jones
*Assistant Examiner*—Abraham Bahta
*Attorney, Agent, or Firm*—John P. McGonagle

[57] ABSTRACT

A universal camouflage system comprised of one or more bundles of elongated material strips attached to a spring-loaded clip. The bundles may be attached by means of the clips to garments, equipment, and natural environment objects and growth, without any requirements that they be modified to receive the bundles.

4 Claims, 2 Drawing Sheets

UNIVERSAL THREE-DIMENSIONAL CAMOUFLAGE SYSTEM

BACKGROUND OF THE INVENTION

This invention relates to camouflage systems, and more particularly to a three-dimensional camouflage system which may be universally applied to clothing, blinds, equipment, vehicles, and the like.

It is known to provide two-dimensional camouflage patterns on clothing, clothing products, packs, accessories, equipment, vehicles and the like. Three-dimensional camouflage systems have been developed, especially for garments. In these prior art systems, the three-dimensional system is usually integrated into the garments or the garments are permanently altered to accommodate a three-dimensional system. While these camouflage systems may be suitable for the particular sets of garments and purposes to which they address, they are not readily adaptable for non-modified garments, equipment and other changes in circumstances. Prior art three-dimensional garment camouflage systems are detachable and adjustable only to garments outfitted to accommodate such actions.

Among the known, three-dimensional camouflage systems, are U.S. Pat. Nos. 5,274,848 (Shamblin); 5,203,033 (Sheppard, Sr. et al.); 5,010,589 (Hamilton); 4,792,471 (Lee); and 4,517,230 (Crawford). Shamblin discloses a system comprising a camouflage structure (14) in conjunction with a garment (12) worn by a person. The camouflage structure (14) consists of burlap strips (20) sewn to a material piece (16) with fasteners (42) permanently attached thereto. The garment (12) has a number of fasteners (36) corresponding to the camouflage structure fasteners (42) attached thereto. Sheppard, Sr. et al. discloses a garment (10) having a number of elongated connectors secured at each end so as to form connector loops (16) extending outwardly of the garment. A camouflage element (12) comprised of a pair of simulated leaves (17, 18) having a common stem (14) are connected to each loop. Hamilton discloses a removable fringe (13) in the form of a multiplicity of elongated elements connected to clothing (10) that has a camouflage design. The fringe is attached to a sheet (12) of material which is attached to the garment by means of elastic bands or rings (14). Lee discloses a camouflage wrapping strip (10) with artificial foliage elements (30–36) fastened to the strip at longitudinally spaced positions. The strip has snap fasteners (26, 28) to loosely lock the strip about the body of a person (12). Crawford discloses a camouflage leaf construction (1) which is attached to a hunter's clothing or equipment (16, 17, 18). The leaf construction consists of a leaf (2) with a stem (3) permanently secured to a fastening material (8). The leaf construction is adapted to be permanently secured to various articles of clothing.

SUMMARY OF THE INVENTION

The present invention is adapted to being used on any garment, object, person, fixture, equipment, vehicle, and the like. To accomplish this, the present invention provides a bundle of elongated material strips attached to a spring-loaded clip. A clamp or any other type of spring/stored energy or mechanical fastener. The bundles may be applied to any garment, equipment piece, object, or the like, and may vary in size depending upon the application. The invention provides effective three-dimensional camouflage for clothing, equipment, other gear, and may be easily transferred to the surrounding environment.

A primary objective, therefore, of the present invention is to provide a three-dimensional camouflage system which is universally applicable to clothing and equipment without requiring any modifications to the clothing or equipment.

Another objective of the present invention is to provide a camouflage system which is inexpensive, lightweight, reusable and fully portable.

Still another objective of the present invention is to provide a camouflage system which may be used in a stand-alone mode or as a supplement to existing two- and three-dimensional systems.

Another objective of the present invention is to provide a completely silent camouflage system.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
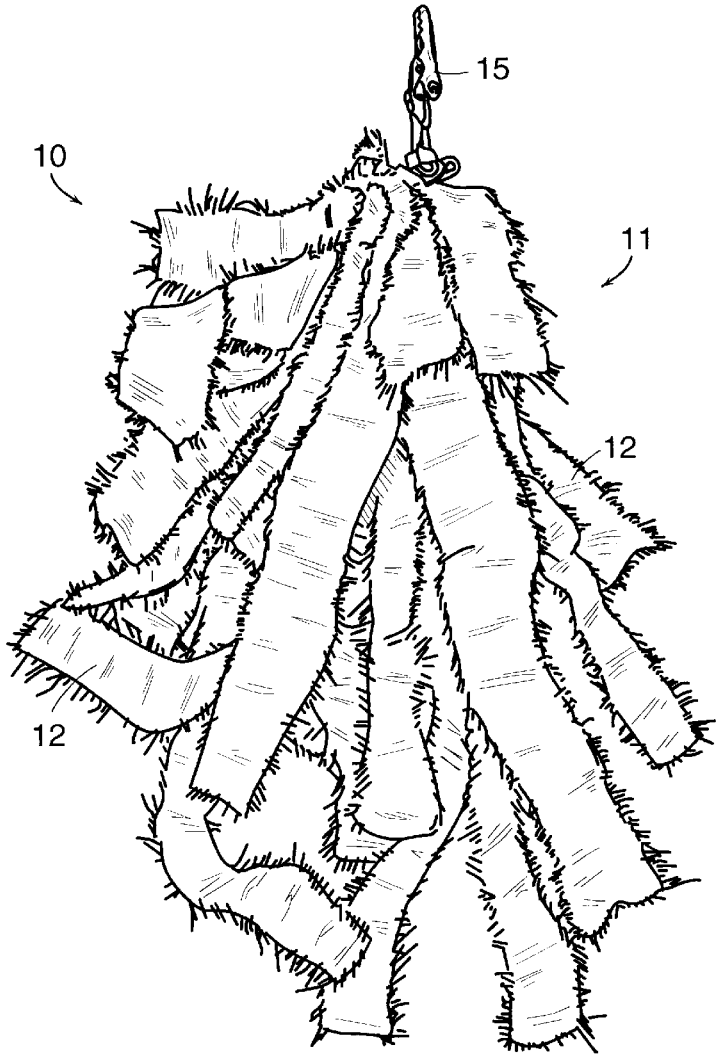
FIG. 1 is a perspective view of a bundle constructed according to the principles of the present invention.

Referring to the drawings in detail wherein like elements are indicated by like numerals, there is shown a universal camouflage system 1 constructed according to the present invention. The system 1 is comprised of one or more camouflage elements 10 comprised of a bundle 11 of elongated strips 12 attached to a spring-loaded clip 15. The elements 10 are attached to garments 2, equipment 3, and any other objects 4 to be used or hidden in a concealed setting.

The elongated strips 12 are of varying lengths, i.e., preferably six to twenty-four inches in length, and may be attached to the clip 15 at the approximate longitudinal midpoint 13 of each strip 12. Each strip 12 is preferably one-half to one and one-half inches wide. Each strip 12 may be of a different color, or may be the same color, e.g., all white for winter applications. The varying lengths and widths of the strips 12 provide an effective three-dimensional break-up of the person or equipment to be camouflaged. The strips 12 themselves are preferably made from a cloth material, but may also be made from manufactured materials such as plastics, nylons, rayons, and the like. When the present invention 1 is used in conjunction with clothing and/or equipment with two-dimensional camouflage patterns, the person or equipment being camouflaged is all but invisible.

Figure 2:
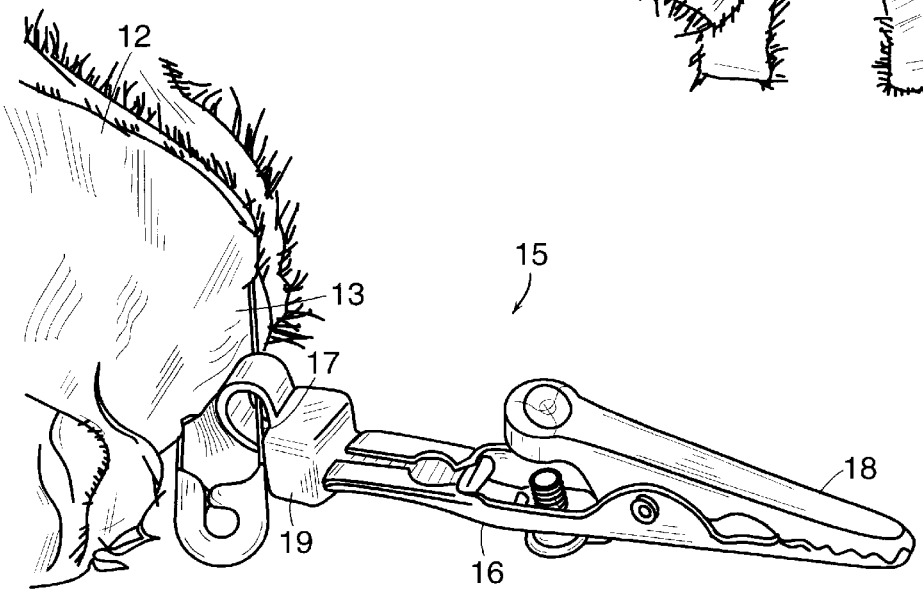
FIG. 2 is a close-up perspective view of the invention's spring-loaded clip.

The clip 15 used in the preferred embodiment is comprised of a spring-loaded clamp 16, e.g., alligator-styled, attached to a pin 17, e.g., safety pin, holding the bundle 11 of strips 12 together. See, especially FIG. 2. The clamp 16 has a clamping end 18 and an attachment end 19. The attachment end 19 terminates in a closed ring shape to which the pin 17 connects. In the preferred embodiment of the invention, the clamp 16 and pin 17 are blackened, either by paint or with a rubberized or plasticized coating. The coatings will also prevent any noise being generated by the clamp 16—pin 17 arrangement, or clips 15 from adjacent elements 10 brushing against each other.

Figure 3:
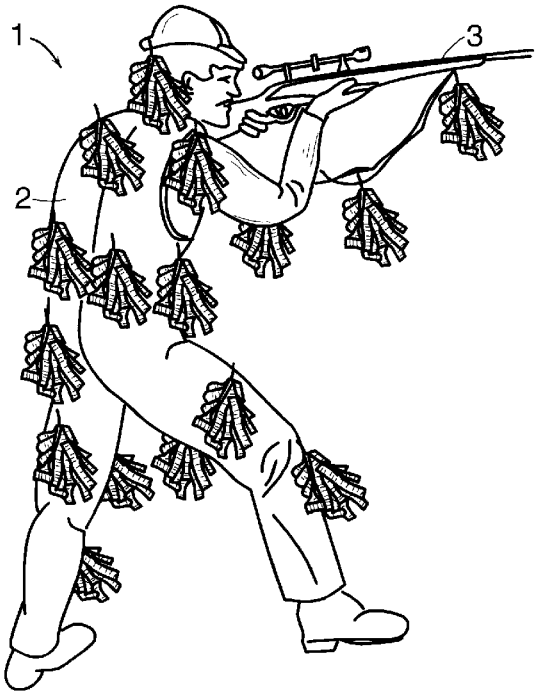
FIG. 3 is a perspective view of a hunter with invention bundles attached to his person and equipment.
Figure 4:
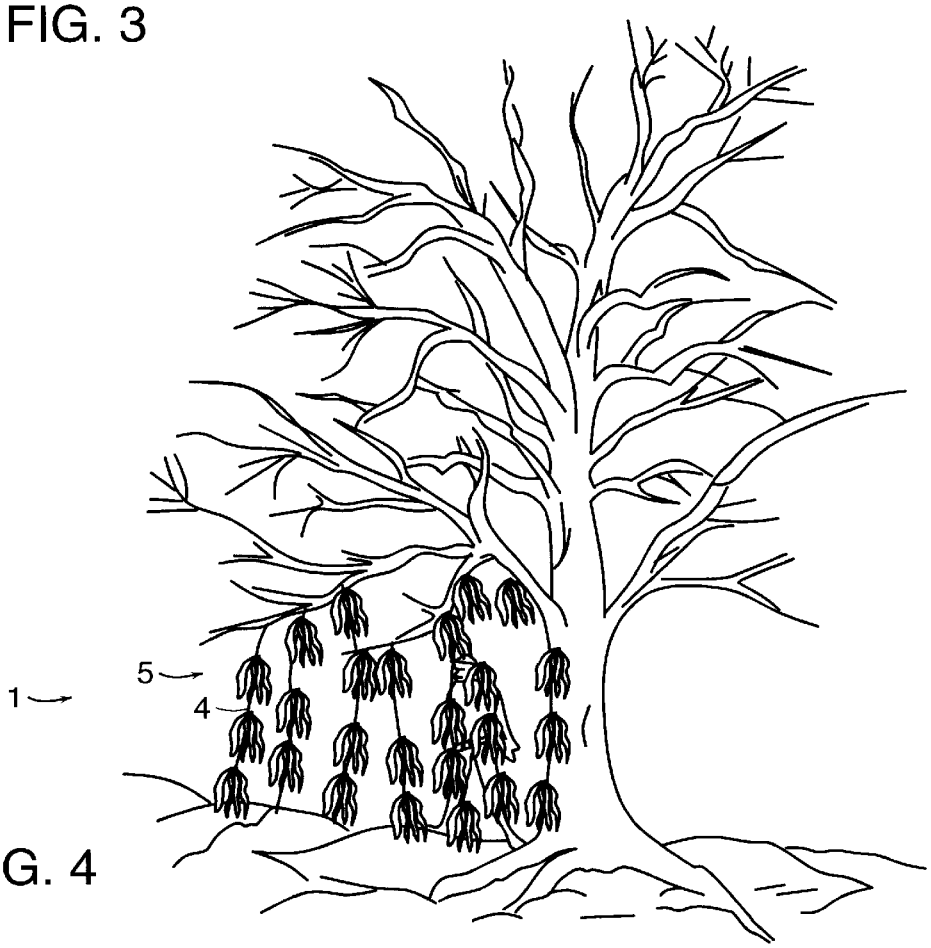
FIG. 4 is a perspective view of the invention used in setting up a hunter's blind.

In operation, a number of camouflage elements 10 would be carried in a pack by the user until the user reaches a desired location or wishes to begin a task requiring concealment, i.e., hunting, military operation, law enforcement, etc. The camouflage elements 10 are removed from temporary storage and quickly and easily applied at random to garments 2 and/or equipment 3. See, for example, FIG. 3. The clamping end 18 is attached to whatever garment 2, equipment 3 or object 4 desired. There are no modifications required of the garments 2, equipment 3 or objects 4. In some situations a blind 5 is desirable. This is easily constructed by attaching camouflage elements 10 to strings, twine wires, etc. or to natural cover. See, for example, FIG. 4.

It is understood that the above-described embodiment is merely illustrative of the application. Other embodiments may be readily devised by those skilled in the art which will embody the principles of the invention and fall within the spirit and scope thereof.

I claim:

1. A universal camouflage system comprised of one or more camouflage elements adapted to being removably attached to an unmodified garment, equipment or object, each said element being comprised of:

a spring-loaded attachment clip;

a bundle of elongated strips attached to said spring-loaded clip;

wherein said attachment clip is adapted to being removably attached to said unmodified garment, equipment or object.

2. A universal camouflage system as recited in claim 1, wherein:

the elongated strips are of varying lengths and widths.

3. A universal camouflage system as recited in claim 2, wherein:

the clip is comprised of a spring-loaded clamp attached to a pin, said pin holding said strips within a bundle together.

4. A universal camouflage system as recited in claim 3, wherein:

the clamp has a clamping end and an attachment end, said attachment end terminating in a closed ring shape to which the pin connects, said clamping end being attached to said garment, equipment or object.

* * * * *